US005910084A

United States Patent [19]

Koike et al.

[11] Patent Number: 5,910,084

[45] Date of Patent: Jun. 8, 1999

[54] REINFORCING STRUCTURE FOR VERTICAL FRAME MEMBER OF SASH FRAME

[75] Inventors: Sou Koike; Masao Hirano, both of Toyama-ken, Japan

[73] Assignee: YKK Architectural Products Inc., Tokyo, Japan

[21] Appl. No.: 08/741,114

[22] Filed: Oct. 30, 1996

[30] Foreign Application Priority Data

Oct. 31, 1995 [JP] Japan ..... 7-283141

[51] Int. Cl.[6] ..... E06B 1/32

[52] U.S. Cl. ..... 52/204.1; 52/98; 52/730.4; 52/733.4

[58] Field of Search ..... 52/204.1, 204.5, 52/210, 730.1, 730.3, 730.4, 730.5, 730.6, 731.1, 731.2, 731.3, 731.5, 733.4, 734.1, 734.2, 736.3, 736.4, 738.1, 98, 100

[56] References Cited

U.S. PATENT DOCUMENTS

| | | | |
|---|---|---|---|
| 3,023,859 | 3/1962 | Muessel | 52/730.4 X |
| 3,552,077 | 1/1971 | Hemminger | 52/730.4 X |
| 4,096,678 | 6/1978 | Diels et al. | 52/731.3 X |
| 4,977,722 | 12/1990 | Taylor | 52/730.4 X |

FOREIGN PATENT DOCUMENTS 61-159584 10/1986 Japan .

*Primary Examiner*—Carl D. Friedman
*Assistant Examiner*—Kevin D. Wilkens
*Attorney, Agent, or Firm*—Finnegan, Henderson, Farabow, Garrett & Dunner, L.L.P.

[57] ABSTRACT

In a reinforcing structure for reinforcing a vertical frame member made of aluminum material and constituting a sash frame by attaching thereto a reinforcing member made of steel, the reinforcing member is an elongated member composed of an indoor side piece, an outdoor side piece and a connection piece. The vertical frame member comprises an indoor side vertical plate member, an outdoor side vertical plate member and a connection plate member. The indoor side vertical plate member has an end portion which is bent to form an indoor side recessed portion continuously extending in the longitudinal direction thereof, and the outdoor side vertical plate member has an end portion which is bent to form an outdoor side recessed portion continuously extending in the longitudinal direction thereof. The reinforcing member is attached to the vertical frame member in the manner that the indoor side, outdoor side and connection pieces of the reinforcing member respectively face the indoor side vertical, outdoor side vertical and connection plate members of the vertical frame member, and that end portions of the indoor side and outdoor side pieces of the reinforcing member are respectively inserted in the indoor side and outdoor side recessed portions of the vertical frame member.

3 Claims, 5 Drawing Sheets

REINFORCING STRUCTURE FOR VERTICAL FRAME MEMBER OF SASH FRAME

BACKGROUND OF THE INVENTION

The present invention relates to a reinforcing structure for reinforcing a vertical frame member constituting a sash frame of a sash to be mounted in an opening of a building so that the vertical frame member may not be largely curved or deformed along the longitudinal direction thereof by wind pressure or the like.

Generally, a sash to be mounted in an opening of a building is constructed as follows: An upper transverse frame member, a lower transverse frame member and vertical frame members are connected with each other to form a rectangular sash frame, and a glass, a door or the like is mounted in this sash frame to form a sash.

The upper and lower transverse frame members constituting the sash frame of the sash are fixed to the upper and lower edge portions of the opening of the building, respectively. On the other hand, the vertical frame members are not always fixed to the vertical edge portions of the opening of the building. For example, in a transversely continuous multiple window in which a plurality of sash frames are continuously mounted in the opening of the building, an intermediate vertical frame member is not fixed to the vertical edge portion of the opening of the building but connected to the upper and lower transverse frame members. A mullion, which is an intermediate vertical frame member extended between and connected with the upper and lower transverse members at their longitudinal intermediate portions, is not fixed to the vertical edge portion of the opening of the building, either.

The upper transverse frame member, the lower transverse frame member and the vertical frame members are formed of aluminum material through an extrusion molding process. Therefore, the respective frame members have low rigidity and are easily curved or deformed along their longitudinal direction.

Therefore, it may happen that the vertical frame member which is not fixed to the vertical edge portion of the opening of the building is largely curved or deformed along the longitudinal direction by high wind pressure such as in a typhoon, and as a result, a glass mounted in the sash frame comes off the sash frame and/or is damaged.

In order to solve this problem, a reinforcing member formed of steel is attached to the vertical frame member continuously along the longitudinal direction to thereby reinforce the vertical frame member and prevent the vertical frame member from being largely curved or deformed along the longitudinal direction by wind pressure.

In order to prevent the vertical frame member from being largely curved or deformed along the longitudinal direction by providing the reinforcing member, it is necessary to attach the reinforcing member to the vertical frame member in the manner that the force tending to curve or deform the vertical frame member is transmitted to the reinforcing member.

Therefore, in the prior art, the reinforcing member is connected to the vertical frame member by a large number of screws to ensure that the force tending to curve or deform the vertical frame member is transmitted to the reinforcing member.

However, for this structure, troublesome works are required such as forming to the reinforcing member a large number of holes through which a large number of screws are inserted, and fastening a large number of screws. Further, the cost is increased owing to the use of a large number of screws.

SUMMARY OF THE INVENTION

An object of the present invention is to substantially eliminate defects or drawbacks encountered in the prior art described above and to provide a reinforcing structure for reinforcing a vertical frame member of a sash frame in which a force tending to curve or deform the vertical frame member is surely transmitted to the reinforcing member to thereby prevent the vertical frame member from being largely curved or deformed along its longitudinal direction and in which the reinforcing member can be easily attached to the vertical frame member.

These and other objects can be achieved, according to one aspect of the present invention, by a reinforcing structure for reinforcing a vertical frame member made of aluminum material and constituting a sash frame by attaching thereto a reinforcing member made of steel, wherein the reinforcing member is an elongated member composed of an indoor side piece, an outdoor side piece provided to face the indoor side piece and a connection piece provided to connect the indoor side and outdoor side pieces, the vertical frame member comprises an indoor side vertical plate member, an outdoor side vertical plate member provided to face the indoor side vertical plate member and a connection plate member provided to connect the indoor side and outdoor side vertical plate members, the indoor side vertical plate member has an end portion which is bent to form an indoor side recessed portion continuously extending in the longitudinal direction of the indoor side vertical plate member, the outdoor side vertical plate member has an end portion which is bent to form an outdoor side recessed portion continuously extending in the longitudinal direction of the outdoor side vertical plate member, and the reinforcing member is attached to the vertical frame member in the manner that the indoor side, outdoor side and connection pieces of the reinforcing member respectively face the indoor side vertical, outdoor side vertical and connection plate members of the vertical frame member, and that end portions of the indoor side and outdoor side pieces of the reinforcing member are respectively inserted in the indoor side and outdoor side recessed portions of the vertical frame member.

In this structure, owing to the arrangement that the end portions of the indoor side piece and the outdoor side piece of the reinforcing member are respectively inserted in the indoor side recessed portion and the outdoor side recessed portion of the vertical frame member, it is ensured that the force tending to curve or deform the vertical frame member is transmitted to the indoor side piece and the outdoor side piece of the reinforcing member when the vertical frame member is curved or deformed toward the indoor side or the outdoor side along its longitudinal direction by wind pressure. Therefore, the vertical frame member is reinforced to the degree corresponding to the section of the reinforcing member.

Further, the reinforcing member is attached to the vertical frame member merely by inserting the reinforcing member in the vertical frame member along the longitudinal direction thereof. Therefore, the attachment of the reinforcing member can be easily carried out, and since a large number of screws are not necessary for the attachment of the reinforcing member, the cost can be reduced.

According to another aspect of the present invention, there is provided a reinforcing structure for reinforcing a vertical frame member made of aluminum material and constituting a sash frame by attaching thereto a reinforcing member made of steel, wherein the reinforcing member is an elongated plate-like member, the vertical frame member comprises an indoor side vertical plate member, an outdoor side vertical plate member provided to face the indoor side vertical plate member and a connection plate member provided to connect the indoor side and outdoor side vertical plate members, the indoor side vertical plate member has an indoor side main fin piece and an indoor side auxiliary fin piece integrally formed therewith to project toward the outdoor vertical plate member substantially parallel to each other, the outdoor side vertical plate member has an outdoor side main fin piece and an outdoor side auxiliary fin piece integrally formed therewith to project toward the indoor vertical plate member substantially parallel to each other, and the reinforcing member is attached to the vertical frame member in the manner that the reinforcing member is inserted between the indoor side main and auxiliary fin pieces and between the outdoor side main and auxiliary fin pieces and pressed against and fixed to the indoor side and outdoor side main fin pieces by bending and pressing the indoor side and outdoor side auxiliary fin pieces onto the reinforcing member.

According to this structure in which the reinforcing member is pressed against and fixed to the indoor side and outdoor side main fin pieces by bending and pressing the indoor side and outdoor side auxiliary fin pieces onto the reinforcing member, the reinforcing member can be steadily fixed without requiring troublesome works and without use of a large number of screws.

The nature and further features of the present invention will be made clearer from the following description made with reference to the accompanying drawings.

DESCRIPTION OF THE PREFERRED EMBODIMENTS

Figure 1:
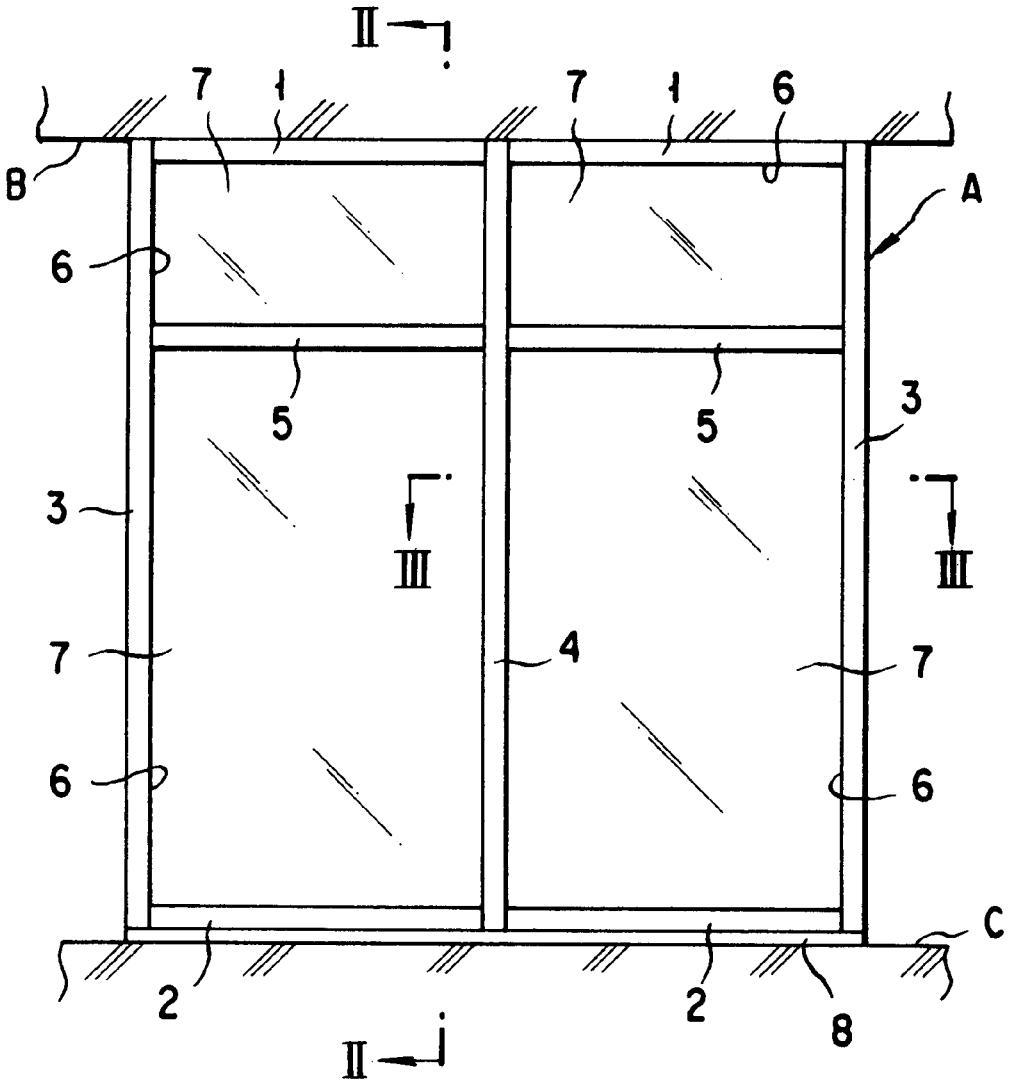
FIG. 1 is an illustrated front view showing an entire structure of a sash according to an embodiment of the present invention.

As shown in FIG. 1, an upper transverse frame member 1, a lower transverse frame member 2, bilateral, i.e., left and right vertical frame members 3, an intermediate vertical frame member 4 and an intermediate transverse frame member 5 are assembled to form a sash frame A. In detail, the upper transverse frame member 1, the intermediate transverse frame member 5 and the lower transverse frame member 2 are extended between and connected with one of the vertical frame members 3 and the intermediate vertical frame member 4, and the upper transverse frame member 1, the intermediate transverse frame member 5 and the lower transverse frame member 2 are extended between and connected with the same intermediate vertical frame member 4 and the other vertical frame member 3, thereby constituting the sash frame A.

The sash frame A comprises opened frame sections 6 for attachment of glasses 7 at its bilateral upper and lower portions and is used to constitute a sash, for example, a storefront sash.

The above-mentioned sash is installed to an opening of a building body. For example, the upper transverse frame member 1 is attached to the upper edge portion B of the opening, an attachment transverse member 8 is attached to the lower edge portion C of the opening, and the lower transverse frame member 2 is attached to the attachment transverse member 8.

The attachment transverse member 8 is an elongated member extending from one of the vertical frame members 3 to the other vertical frame member 3, and is provided to receive rain water flowing, for example, through connecting portions between the lower transverse frame member 2 and each of the vertical frame members 3 and the intermediate vertical frame member 4 to thereby prevent the rain water from flowing to the lower edge portion C of the opening.

Figure 2:
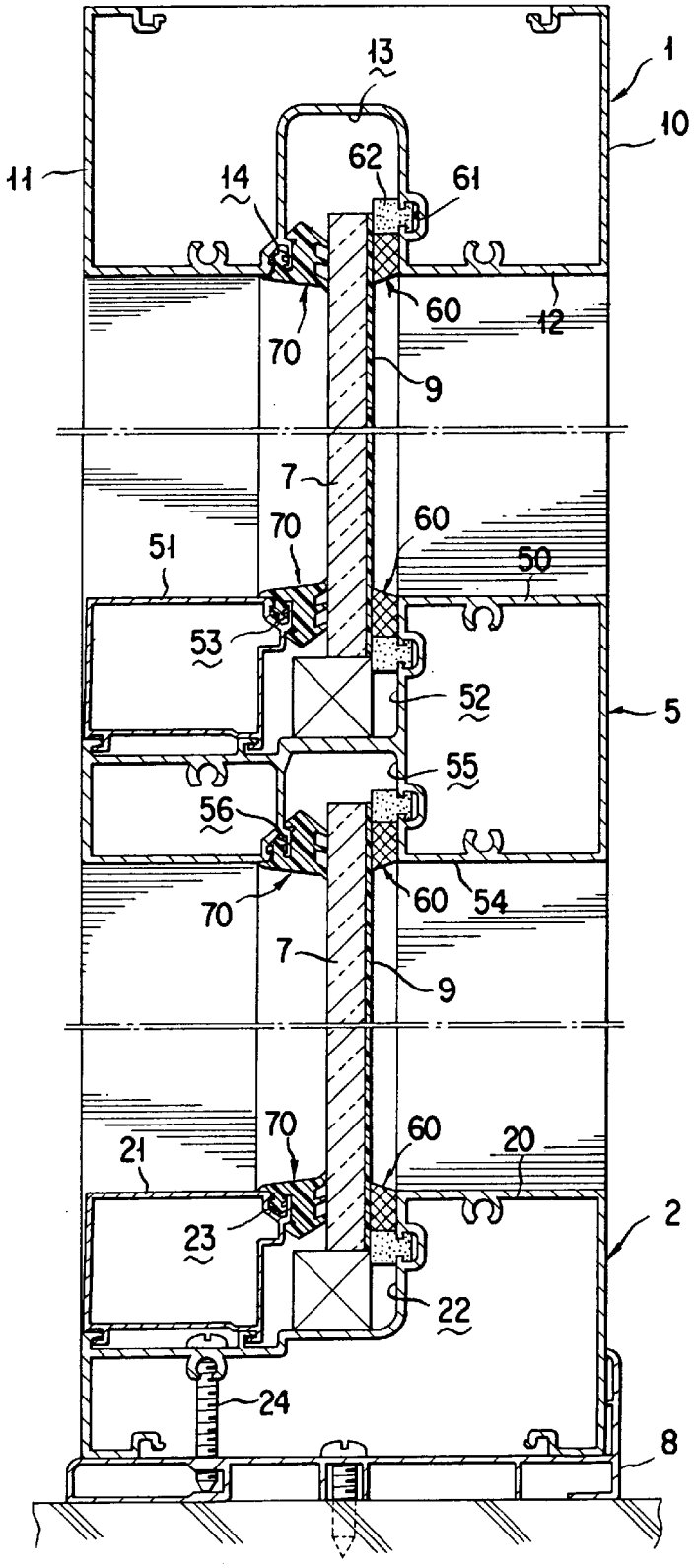
FIG. 2 is a sectional view taken along the line II—II in FIG. 1.

As shown in FIG. 2, a scattering preventing film 9 made of polyester film or the like is applied through heat fusing process to the indoor side surface of the glass 7. By the scattering preventing film 9, the glass 7 is prevented from being separated and scattered in pieces even if a certain object is blown off by a strong wind and collides with and cracks or breaks the glass 7.

As shown in FIG. 2, the upper transverse frame member 1 is composed of an indoor side vertical plate member 10, an outdoor side vertical plate member 11 and a connection plate member 12 and has substantially an upward opening C-shape cross section. The connection plate member 12 is provided with an inward opening glass attachment channel 13 and an inward opening seal member fitting groove 14 adjacent to the glass attachment channel 13. (Here and hereinafter, the word "inward" shall mean the direction directed to the inside of the opened frame section 6.)

The lower transverse frame member 2 is formed by attaching a bead member 21 to a body frame member 20 so as to have an inward opening glass attachment channel 22. The bead member 21 is formed with an inward opening seal member fitting groove 23. The body frame member 20 is connected to the attachment transverse member 8 by means of screws 24.

Figure 3:
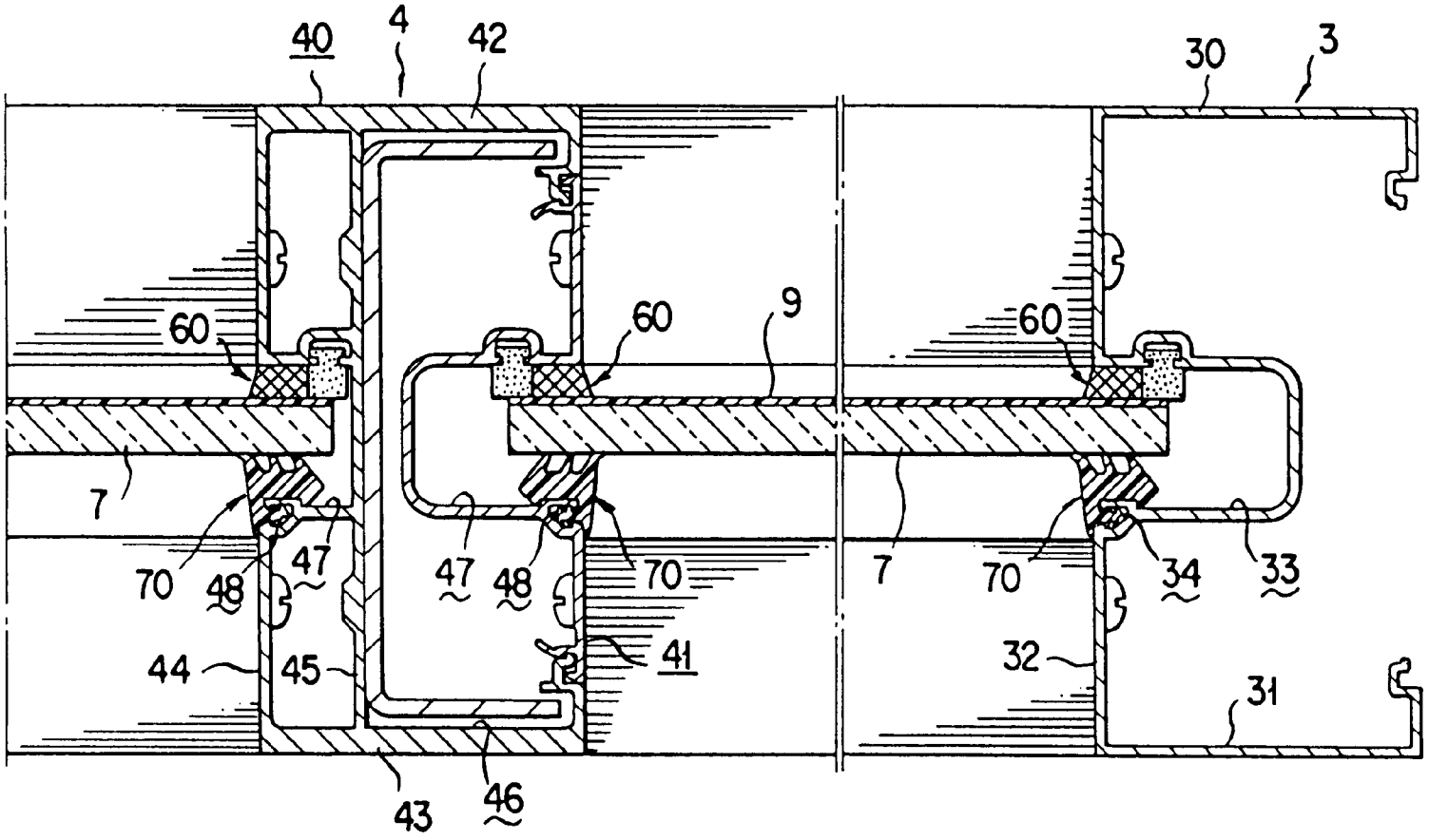
FIG. 3 is a sectional view taken along the line III—III in FIG. 1.

As shown in FIG. 3, the vertical frame member 3 is composed of an indoor side vertical plate member 30, an outdoor side vertical plate member 31 and a connection plate member 32 and has substantially an outward opening C-shape cross section. (Here and hereinafter, the word "outward" shall mean the direction directed to the outside of the opened frame section 6.) The connection plate member 32 is provided with an inward opening glass attachment channel 33 and a seal member fitting groove 34 adjacent to the glass attachment channel 33.

The intermediate vertical frame member 4 is formed by connecting an auxiliary frame member 41 to a body frame member 40. The body frame member 40 is composed of an indoor side vertical plate member 42, an outdoor side vertical plate member 43, an end connection plate member 44 and an intermediate connection plate member 45, and has substantially a C-shape cross section provided with an auxiliary frame member attachment recess 46. The end connection plate member 44 and the auxiliary frame member 41 are respectively formed with an inward opening glass attachment channel 47 and a seal member fitting groove 48 adjacent to the glass attachment channel 47.

As shown in FIG. 2, the intermediate transverse frame member 5 is formed by attaching a bead member 51 to a body frame member 50 so as to have an inward opening glass attachment channel 52. The bead member 51 is formed with an upward opening seal member fitting groove 53. The lower transverse plate member 54 of the body frame member 50 is formed with an inward opening glass attachment channel 55 and an inward opening seal member fitting groove 56 adjacent to the glass attachment channel 55.

From the respective structures mentioned above, it follows that the glass attachment channels and the seal member fitting grooves are formed on the inner surface of each opened frame section 6 of the sash frame A continuously along the four peripheral sides of the opened frame section 6. The glass 7 is inserted in the glass attachment channels and supported by indoor side seal members 60 and outdoor side seal members 70.

A reinforcing structure of the intermediate vertical frame member 4 will be described hereunder with reference to FIG. 4.

The body frame member 40 and the auxiliary frame member 41 constituting the intermediate vertical frame member 4 are formed of aluminum material through an extrusion molding process, respectively. An indoor side vertical plate member 42, an outdoor side vertical plate member 43 and an intermediate connection plate member 45 of the body frame member 40 and the auxiliary frame member 41 cooperate to constitute a hollow structure continuously extending in the longitudinal direction of the intermediate vertical frame member 4.

A reinforcing member 100 made of steel is inserted in this hollow structure to continuously extend in the longitudinal direction thereof. The reinforcing member 100 is composed of an indoor side piece 101, an outdoor side piece 102 and a connection piece 103, and has substantially a C-shape cross section. The connection piece 103 of the reinforcing member 100 is provided to face the intermediate connection plate member 45 of the body frame member 40, the indoor side piece 101 is provided to face the indoor side vertical plate member 42 and the outdoor side piece 102 is provided to face the outdoor side vertical plate member 43.

The end portion 42*a* of the indoor side vertical plate member 42 of the body frame member 40 is bent in a hook shape to form an indoor side recessed portion 104 opening opposite to the intermediate connection plate member 45. An indoor side engaging piece 105 is integrally formed to the end portion 42*a* of the indoor side vertical plate member 42 to project toward the outdoor side vertical plate member 43. The indoor side engaging piece 105 is bent in crank-like shape and comprises an engaging recessed portion 106 and an engaging projection 107.

The end portion 43*a* of the outdoor side vertical plate member 43 of the body frame member 40 is bent in a hook shape to form an outdoor side recessed portion 108 opening opposite to the intermediate connection plate member 45. An outdoor side engaging piece 109 is integrally formed to the end portion 43*a* of the outdoor side vertical plate member 43 to project toward the indoor side vertical plate member 42. The outdoor side engaging piece 109 is bent in crank-like shape and comprises an engaging recessed portion 110 and an engaging projection 111.

The end portion of the indoor side piece 101 of the reinforcing member 100 is inserted in the indoor side recessed portion 104, and the end portion of the outdoor side piece 102 is inserted in the outdoor side recessed portion 108.

Figure 4:
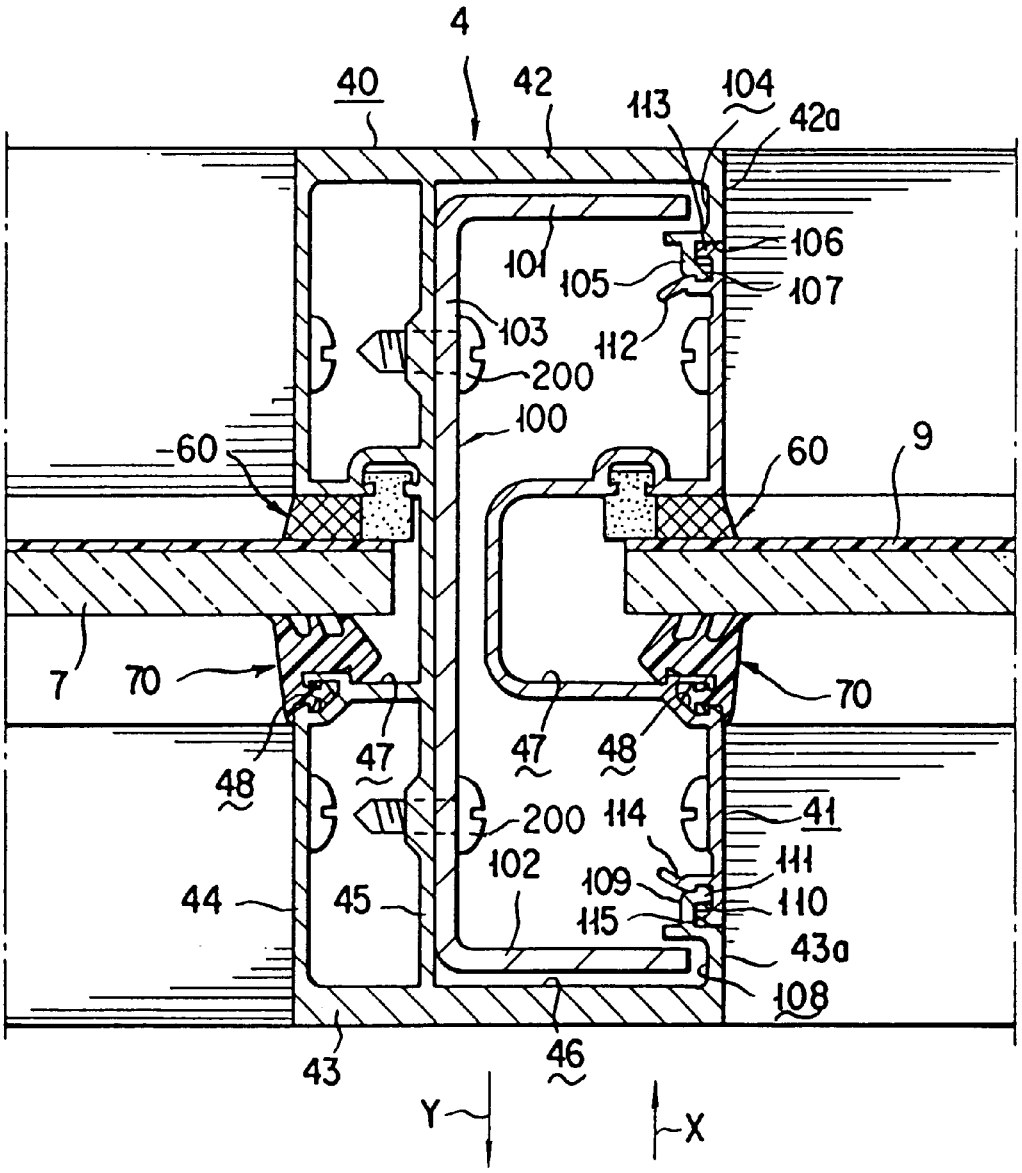
FIG. 4 is an enlarged sectional view of one example of a reinforcing structure of an intermediate vertical frame member.

In the embodiment shown in FIG. 4, arrangement is so made that the indoor side piece 101 and the outdoor side piece 102 are slightly spaced apart from the indoor side vertical plate member 42 and the outdoor side vertical plate member 43, respectively, and that the end portion of the indoor side piece 101 and the end portion of the outdoor side piece 102 are slightly spaced apart from the indoor side recessed portion 104 and the outdoor side recessed portion 108, respectively.

Therefore, even if the body frame member 40 is molded with a slight deformation in the longitudinal direction, the reinforcing member 100 can be smoothly inserted in the body frame member 40 along the longitudinal direction without interfering therewith.

If it is ensured that the body frame member 40 is molded straight without deformation in the longitudinal direction, such arrangement is preferable that the indoor side piece 101 and the outdoor side piece 102 are in contact with the indoor side vertical plate member 42 and the outdoor side vertical plate member 43 respectively, and that the end portion of the indoor side piece 101 and the end portion of the outdoor side piece 102 tightly fit in the indoor side recessed portion 104 and the outdoor side recessed portion 108 respectively.

The entire longitudinal length of the reinforcing member 100 is slightly shorter than the entire longitudinal length of the body frame member 40. The reinforcing member 100 is not connected to the body frame member 40 but is supported on at least one screw 200 which is fastened to the lower portion of the intermediate connection plate 45 of the body frame member 40 so that the reinforcing member 100 may not fall off the body frame member 40. It is also possible that the reinforcing member 100 thus supported on the screw is further connected to the intermediate connection plate 45 by means of at least one screw in order to enhance the unity as the vertical frame member.

When wind pressure acts on the sash as positive pressure (force pushing the sash toward the indoor side) as indicated by an arrow X in FIG. 4, the intermediate vertical frame member 4 is curved or deformed toward the indoor side along its longitudinal direction. As a result, the outdoor side vertical plate member 43 comes in contact with the outdoor side piece 102, and the hook-shaped end portion 42*a* of the indoor side vertical plate member 42 comes in contact with the indoor side piece 101. Therefore, through the deformation of the intermediate vertical frame member 4, the force tending to curve or deform the intermediate vertical frame member 4 is surely transmitted to the reinforcing member 100.

When wind pressure acts on the sash as negative pressure (force pulling the sash toward the outdoor side) as indicated by an arrow Y in FIG. 4, the intermediate vertical frame member 4 is curved or deformed toward the outdoor side along its longitudinal direction. As a result, the indoor side vertical plate member 42 comes in contact with the indoor side piece 101, and the hook-shaped end portion 43*a* of the outdoor side vertical plate member 43 comes in contact with the outdoor side piece 102. Therefore, through the deformation of the intermediate vertical frame member 4, the force tending to curve or deform the intermediate vertical frame member 4 is transmitted to the reinforcing member 100.

As described above, when the intermediate vertical frame member 4 is curved or deformed toward the indoor side or the outdoor side, the force tending to curve or deform the intermediate vertical frame member 4 is transmitted to the indoor side piece 101 and the outdoor side piece 102 of the reinforcing member 100. Therefore, the intermediate vertical frame member 4 is reinforced to the degree corresponding to the section of the reinforcing member 100.

The reinforcing member 100 is attached to the intermediate vertical frame member 4 merely by inserting the reinforcing member 100 in the hollow structure of the intermediate vertical frame member 4 along the longitudinal direction thereof. Therefore, the attachment of the intermediate vertical frame member 4 can be easily carried out.

The connection of the body frame member 40 and the auxiliary frame member 41 of the intermediate vertical frame member 4 will be described hereunder.

An indoor side first engaging piece 112 and an indoor side second engaging piece 113 are integrally formed to the indoor side portion of the auxiliary frame member 41, and an outdoor side first engaging piece 114 and an outdoor side second engaging piece 115 are integrally formed to the outdoor side portion of the auxiliary frame member 41.

The auxiliary frame member 41 is attached to the body frame member 40 by engaging the indoor side first engaging piece 112 of the auxiliary frame member 41 with the engaging projection 107 of the indoor side vertical plate member 42 and by engaging the outdoor side first engaging piece 114 of the auxiliary frame member 41 with the engaging projection 111 of the outdoor side vertical plate member 43. Therefore, the attachment of the auxiliary frame member 41 to the body frame member 40 can be easily carried out.

When the auxiliary frame member 41 is attached to the body frame member 40 as described above, the indoor side second engaging piece 113 and the outdoor side second engaging piece 115 of the auxiliary frame member 41 fit in the engaging recessed portion 106 of the indoor side vertical plate member 42 and the engaging recessed portion 110 of the outdoor side vertical plate member 43, respectively.

Thus, the indoor side vertical plate member 42 of the body frame member 40 and the indoor side end portion of the auxiliary frame member 41 are firmly connected so that they do not shift from each other, and the outdoor side vertical plate member 43 of the body frame member 40 and the outdoor side end portion of the auxiliary frame member 41 are also firmly connected so that they do not shift from each other.

That is, the intermediate vertical frame member 4, which is composed of two seperate members, the body frame member 40 and the auxiliary frame member 41, is like an integrally formed one member with regard to the strength, and accordingly, the twist and deformation along the longitudinal direction of the intermediate vertical frame member 4 owing to the wind pressure is restrained. This also holds true when the reinforcing member 100 is not attached.

In the above described embodiment, the intermediate vertical frame member 4 is composed of two separate members, of the body frame member 40 and the auxiliary frame member 41. However, the intermediate vertical frame member may also be an integrally formed member uniting the body frame member 40 and the auxiliary frame member 41.

Figure 5:
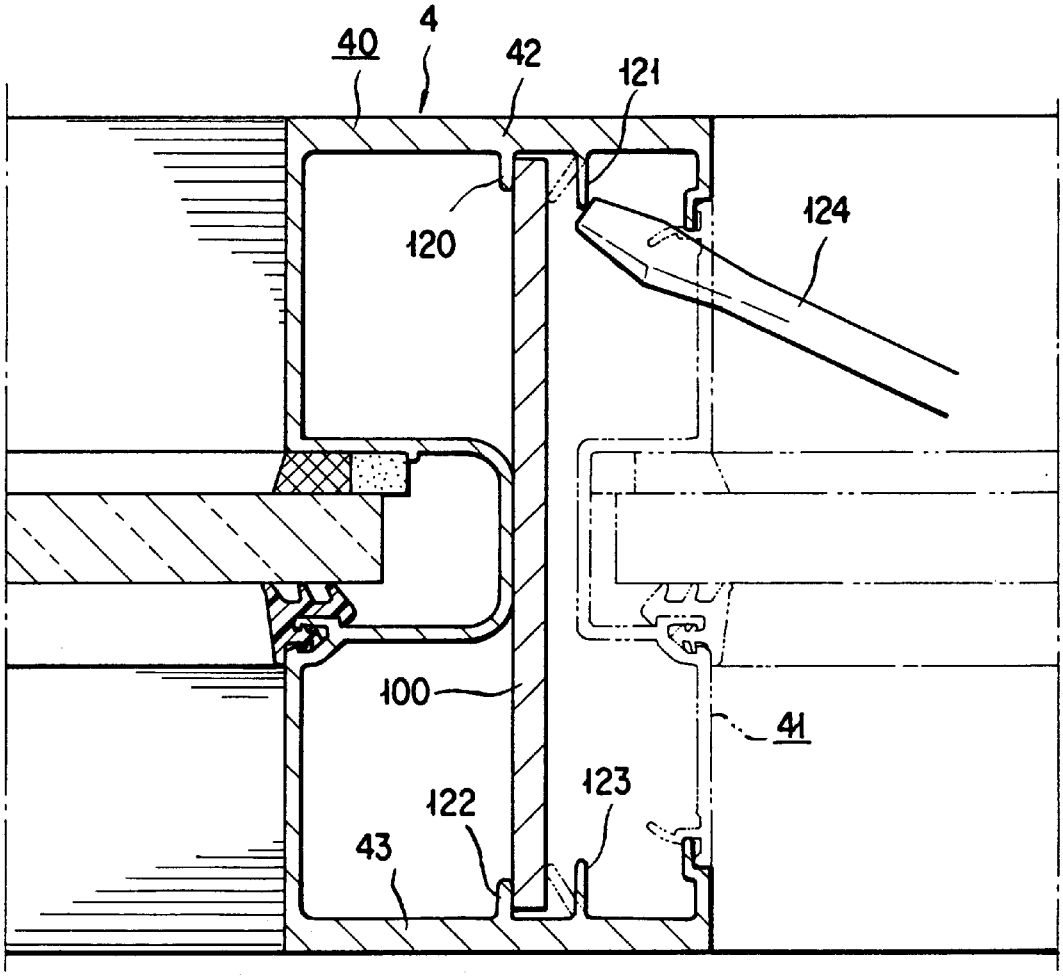
FIG. 5 is an enlarged transverse sectional view of another example of a reinforcing structure of an intermediate vertical frame member.

A second embodiment of the present invention will be further described hereunder with reference to FIG. 5.

An indoor side main fin piece 120 and an indoor side auxiliary fin piece 121 are integrally formed to the indoor side vertical plate member 42 of the body frame member 40 in the manner that they project toward the outdoor side vertical plate member 43 substantially parallel to each other. The indoor side auxiliary fin piece 121 is positioned to the side of the auxiliary frame member 41 as compared with the indoor side main fin piece 120 and has a length slightly longer than that of the indoor side main fin piece 120 and a thickness thinner than that of the indoor side main fin piece 120.

An outdoor side main fin piece 122 and an outdoor side auxiliary fin piece 123 are integrally formed to the outdoor side vertical plate member 43 of the body frame member 40 in the manner that they project toward the indoor side vertical plate member 42 substantially parallel to each other and opposite to the indoor side main fin piece 120 and the indoor side auxiliary fin piece 121, respectively. The outdoor side auxiliary fin piece 123 is positioned to the side of the auxiliary frame member 41 as compared with the outdoor side main fin piece 122 and has a length slightly longer than that of the outdoor side main fin piece 122 and a thickness thinner than that of the outdoor side main fin piece 122.

In this embodiment, the reinforcing member 100 has a plate-like shape and is inserted between the indoor side main fin piece 120 and the indoor side auxiliary fin piece 121 and between the outdoor side main fin piece 122 and the outdoor side auxiliary fin piece 123.

The indoor side auxiliary fin piece 121 and the outdoor side auxiliary fin piece 123 are respectively pressed or struck by a tool 124 such as a screwdriver so as to be bent and pressed onto the reinforcing member 100 as shown by two-dots and dash lines in FIG. 5. Thereby, the reinforcing member 100 is pressed against and fixed to the indoor side main fin piece 120 and the outdoor side main fin piece 122.

Thus, by bending the indoor side auxiliary fin piece 121 and the outdoor side auxiliary fin piece 123, the reinforcing member 100 can be steadily fixed and prevented from falling due to its own weight.

Further, the reinforcing member 100 may be of various thicknesses. Therefore it is possible to use a reinforcing member 100 having a different thickness corresponding to the length of the intermediate vertical frame member 4, thereby realizing the reinforced strength of the intermediate vertical frame member 4 corresponding to the length thereof.

What is claimed is:

1. A reinforcing structure, comprising:

a reinforced vertical frame member having an indoor side vertical plate member, an outdoor side vertical plate member and a connection plate member connecting said indoor side and outdoor side vertical plate members, wherein said indoor side vertical plate member has an indoor side main fin piece and an indoor side auxiliary fin piece, each integrally formed to the indoor side vertical plate member so as to project, substantially parallel to one another, toward said outdoor side vertical plate member, and wherein said outdoor side vertical plate member has an outdoor side main fin piece and an outdoor side auxiliary fin piece integrally formed to the outdoor side vertical plate member so as to project substantially parallel to one another and toward said indoor vertical plate member; and an elongated plate-like steel reinforcing member attached to said reinforced vertical frame member in the manner that said reinforcing member is inserted between said indoor side main and auxiliary fin pieces and between said outdoor side main and auxiliary fin pieces and fixed to said indoor side and outdoor side main fin pieces by bending and pressing said indoor and outdoor side auxiliary fin pieces onto said reinforcing member.

2. A reinforcing structure according to claim 1, wherein said indoor side and outdoor side auxiliary fin pieces are bent and pressed onto said reinforcing member.

3. A reinforcing structure according to claim 1, wherein said indoor side auxiliary fin piece has a length slightly longer than that of said indoor side main fin piece and a thickness thinner than that of said indoor side main fin piece, and said outdoor side auxiliary fin piece has a length slightly longer than that of said outdoor side main fin piece and a thickness thinner than that of said outdoor side main fin piece.

* * * * *